US012004612B1

(12) United States Patent
Bhosale

(10) Patent No.: US 12,004,612 B1
(45) Date of Patent: Jun. 11, 2024

(54) JEWELRY SUPPORT SYSTEM AND METHOD FOR SUPPORTING MOTION INDICIA IN JEWELRY CONSTRUCTION

(71) Applicant: Jewelex New York, Ltd., New York, NY (US)

(72) Inventor: Nayan Ramchandra Bhosale, Nalasopara West (IN)

(73) Assignee: JEWELEX NEW YORK, LTD., New York, NY (US)

( * ) Notice: Subject to any disclaimer, the term of this patent is extended or adjusted under 35 U.S.C. 154(b) by 14 days.

(21) Appl. No.: 18/104,742

(22) Filed: Feb. 1, 2023

(51) Int. Cl.
*A44C 7/00* (2006.01)

(52) U.S. Cl.
CPC ..... *A44C 7/007* (2013.01)

(58) Field of Classification Search
CPC ..... A44C 7/00; A44C 17/0275; A44C 13/00
USPC ..... 63/12, 13, 14.1, 26, 30; D11/40, 41, 43
See application file for complete search history.

(56) References Cited

U.S. PATENT DOCUMENTS

| | | | | |
|---|---|---|---|---|
| 2,048,878 | A | 7/1936 | Moldenhauser | |
| 2,107,938 | A | 2/1938 | Harris | |
| D150,546 | S | 8/1948 | Boucher | |
| 2,797,561 | A * | 7/1957 | Vaughn | A44C 7/002 63/29.1 |
| 3,218,826 | A | 11/1965 | De Santo | |
| 4,827,738 | A * | 5/1989 | Rothal | A44C 7/009 D11/42 |
| 4,970,878 | A | 11/1990 | Lee | |
| 5,184,481 | A | 2/1993 | Joseph et al. | |
| D485,204 | S | 1/2004 | Sandberg | |
| 7,121,118 | B2 | 10/2006 | David | |
| 7,347,066 | B1 | 3/2008 | Feuer | |
| D606,510 | S | 12/2009 | Choe | |
| 8,910,496 | B2 | 12/2014 | Monahan | |
| D748,003 | S * | 1/2016 | Vartanian | D11/40 |
| 9,730,497 | B2 | 8/2017 | Huynh | |
| D796,372 | S | 9/2017 | Gruosi | |
| 10,362,841 | B2 | 7/2019 | Okada | |
| D906,858 | S | 1/2021 | Gurung | |
| D926,072 | S | 7/2021 | Messika | |
| 2017/0055647 | A1 | 3/2017 | Samanta | |
| 2022/0079304 | A1 | 3/2022 | Senia | |

FOREIGN PATENT DOCUMENTS

JP 7121434 B1 * 8/2022

* cited by examiner

*Primary Examiner* — Jack W Lavinder
(74) *Attorney, Agent, or Firm* — Andrew F. Young; Nolte Lackenbach Siegel

(57) ABSTRACT

A jewelry support system and method for supporting motion indicia in a jewelry system includes an inner pivot support member and an outer pivot member for an earring. There is a clasp assembly and two outer pivot members extending from the inner side of the outer pivot member positioned along a common pivot plane at two distal pivot locations. There are two inner pivot members that pivotally engage the respective outer pivot members and have tapered contact surfaces so as to provide a single-point contact at each location during a pivot motion so that an enhanced decorative pivot system is achieved with improved reliability.

9 Claims, 5 Drawing Sheets

JEWELRY SUPPORT SYSTEM AND METHOD FOR SUPPORTING MOTION INDICIA IN JEWELRY CONSTRUCTION

CROSS REFERENCE TO RELATED APPLICATIONS

None

FIGURE SELECTED FOR PUBLICATION

FIG. 2

BACKGROUND OF THE INVENTION

Field of the Invention

The invention relates to a jewelry support system and method for supporting motion indicia in a jewelry construction. The invention further relates to a system for allowing a pivoting and optional return-resetting to an outer jewelry item relative to an inner pivot support member for an earring.

Description of the Related Art

The related art of earrings and jewelry is substantial and includes a number of earring post-mount assemblies (piercing or compression) and a number of dual-member mounts (one or more members hanging from a main-earing stud under the force of gravity. Examples of such matters include U.S. Pat. No. 5,184,481 (Joseph) for a hoop jewelry with an ornamental suspended member; and U.S. Pat. No. 7,121,118 (David) for a hoop earring with an inner point-bangle.

The conventional earring structures employ solely a functional-single-pivot arrangement wherein the suspended mass (stone, pearl, pendant element etc.) is restrained at a single common point and is suspended therefrom under gravity. When a user moves their head, the suspended mass shifts in a direct manner along the vector of motion and upon the end of movement revolves around the single common point in an oval or circle until motive energy is eliminated in a series of decreased motions that lose attraction over time.

The conventional earring structures are unfortunately prone to entanglement with a user's hair or other adjacent jewelry items and may be damaged in pivoting.

Also unfortunately, conventional earring structures with suspended elements (which swing as a pendulum) fail to maintain common plane of indica display presented to viewer (e.g., fail to pivot along a common plane) and as a result the perceived attractiveness is minimized.

A further limitation of the conventional art is the weakness of a pivot attachment may prematurely result in item failure and loss of value due to the single-point pendulum action.

ASPECTS AND SUMMARY OF THE INVENTION

The prosed invention provides for a solution to at least one of the concerns and limitations noted above.

The proposed invention further provides an improved mounting arrangement that maintains a viewing indicia plane throughout a range of motion.

The proposed invention further provides for an enhanced securing of a large indicia surface on an outer and an inner jewelry member.

According to one alternative and adaptive embodiment of the present invention, there is provided a jewelry support system and method for supporting motion indicia in a jewelry system includes an inner pivot support member and an outer pivot member for an earring. There is a clasp assembly and two outer pivot members extending from the inner side of the outer pivot member positioned along a common pivot plane at two distal pivot locations. There are two inner pivot members that pivotally engage the respective outer pivot members and have tapered contact surfaces so as to provide a single-point contact at each location during a pivot motion so that an enhanced decorative pivot system is achieved with improved reliability. According to the method, there is provided an arrangement wherein an inner pivot support member with two pivot members and a clasp assembly is assembled with an outer pivot jewelry member allowing pivoting between the two along a common pivot axis.

According to another alternative aspect of the present invention, there is provided a jewelry support system, comprising: an outer jewelry member having an outer indicia surface and an inner support surface, an inner pivot support member having a clasp assembly and an inner indicia surface along an outer surface thereof, an outer top support pivot ring and an outer bottom support pivot ring on distal ends of the outer jewelry member, an inner top pivot member on a top extending pin projecting from a top side of the inner pivot support member, an inner bottom pivot member on a bottom extending pin projecting from a bottom side of aid inner pivot support member, the outer top support pivot ring and the outer bottom support pivot ring being co-planar along a common pivot plane defined therebetween, the inner top pivot member and the inner bottom pivot member arrayed along the common pivot plan and positioned perpendicular to respective the outer top support pivot ring and the outer bottom support pivot ring, and the inner top pivot member pivotally engaged with the outer top support pivot ring and the inner bottom pivot member pivotally engaged with the outer bottom support pivot ring, wherein the inner pivot support member pivotally supports the outer jewelry member so as to allow the outer jewelry member to pivot relative to the inner pivot support member along the common pivot plane.

According to another alternative aspect of the present invention, there is provided a jewelry support system, wherein: the inner top pivot member having a top tapered contact surface contacting the outer top support pivot ring, and the inner bottom pivot member having a bottom tapered contact surface contacting the outer bottom pivot support ring.

According to another alternative aspect of the present invention, there is provided a jewelry support system, wherein: the outer top support ring has a tapered contact surface, and the outer bottom pivot support ring has a tapered contact surface.

According to another alternative aspect of the present invention, there is provided a jewelry support system, wherein: the outer jewelry support member is one of a linear outer jewelry support member and a non-linear outer jewelry support member.

According to another alternative aspect of the present invention, there is provided a jewelry support system, wherein: the inner pivot support member is one of a linear inner pivot support member and a non-linear inner pivot support member.

According to another alternative aspect of the present invention, there is provided a jewelry support system, wherein: the clasp assembly includes a pivot spring arm and a pin.

According to another alternative aspect of the present invention, there is provided a method for assembling a jewelry support system, comprising the steps of: providing an outer jewelry member having an outer indicia surface and an inner support surface, providing an inner pivot support member having a clasp assembly and an inner indicia surface along an outer surface thereof, providing an outer top support pivot ring and an outer bottom support pivot ring on distal ends of the outer jewelry member, providing an inner top pivot member on a top extending pin projecting from a top side of the inner pivot support member, providing an inner bottom pivot member on a bottom extending pin projecting from a bottom side of aid inner pivot support member, providing the outer top support pivot ring and the outer bottom support pivot ring being co-planar along a common pivot plane defined therebetween and the inner top pivot member and the inner bottom pivot member arrayed along the common pivot plan and positioned perpendicular to respective the outer top support pivot ring and the outer bottom support pivot ring, and assembling the inner top pivot member pivotally with the outer top support pivot ring and the inner bottom pivot member pivotally with the outer bottom support pivot ring, wherein the inner pivot support member pivotally supports the outer jewelry member so as to allow the outer jewelry member to pivot relative to the inner pivot support member along the common pivot plane.

According to another alternative aspect of the present invention, there is provided a method for assembling a jewelry support system, wherein: the inner top pivot member having a top tapered contact surface contacting the outer top support pivot ring, and the inner bottom pivot member having a bottom tapered contact surface contacting the outer bottom pivot support ring.

According to another alternative aspect of the present invention, there is provided a method for assembling a jewelry support system, wherein the outer top support ring has a tapered contact surface, and the outer bottom pivot support ring has a tapered contact surface.

The above and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 2:
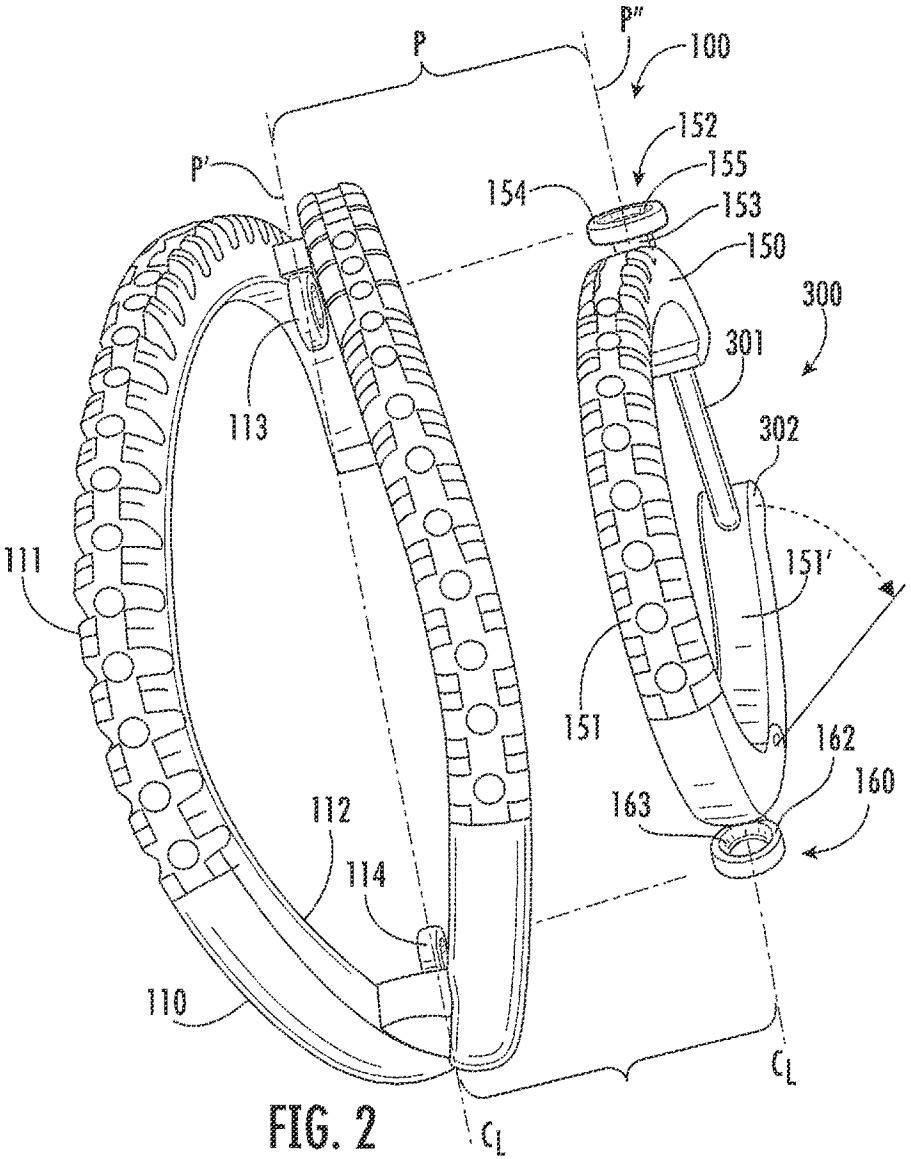
FIG. 2 is an exploded perspective view of FIG. 1.
Figure 1:
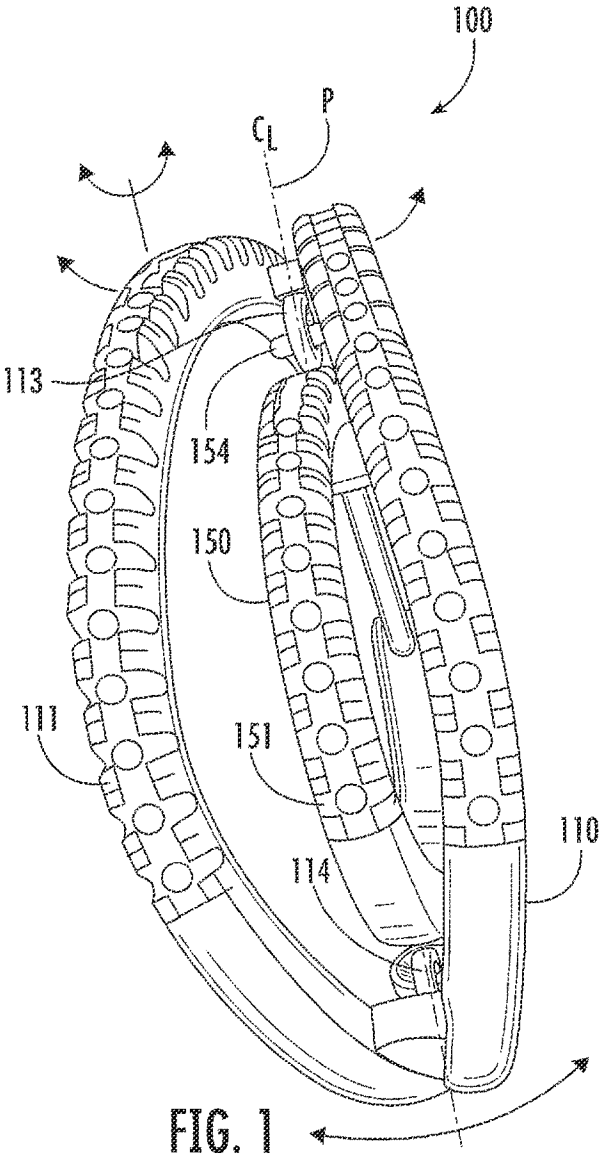
FIG. 1 is a perspective assembly view of a jewelry support system.

Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Various operations may be described as multiple discrete operations in turn, in a manner that may be helpful in understanding embodiments of the present invention; however, the order of description should not be construed to imply that these operations are order dependent.

Figure 3:
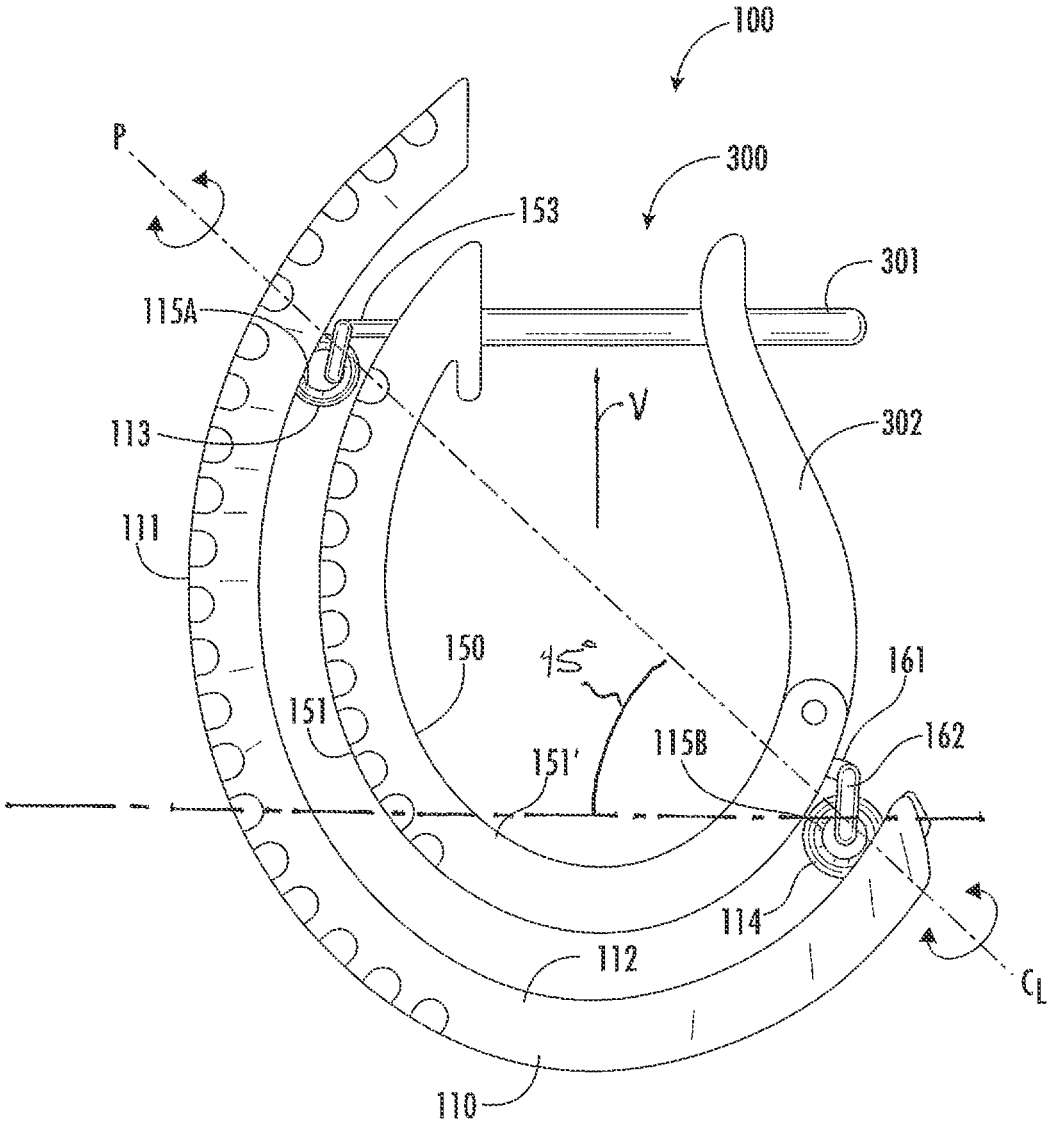
FIG. 3 is a side view of FIG. 2.
Figure 4:
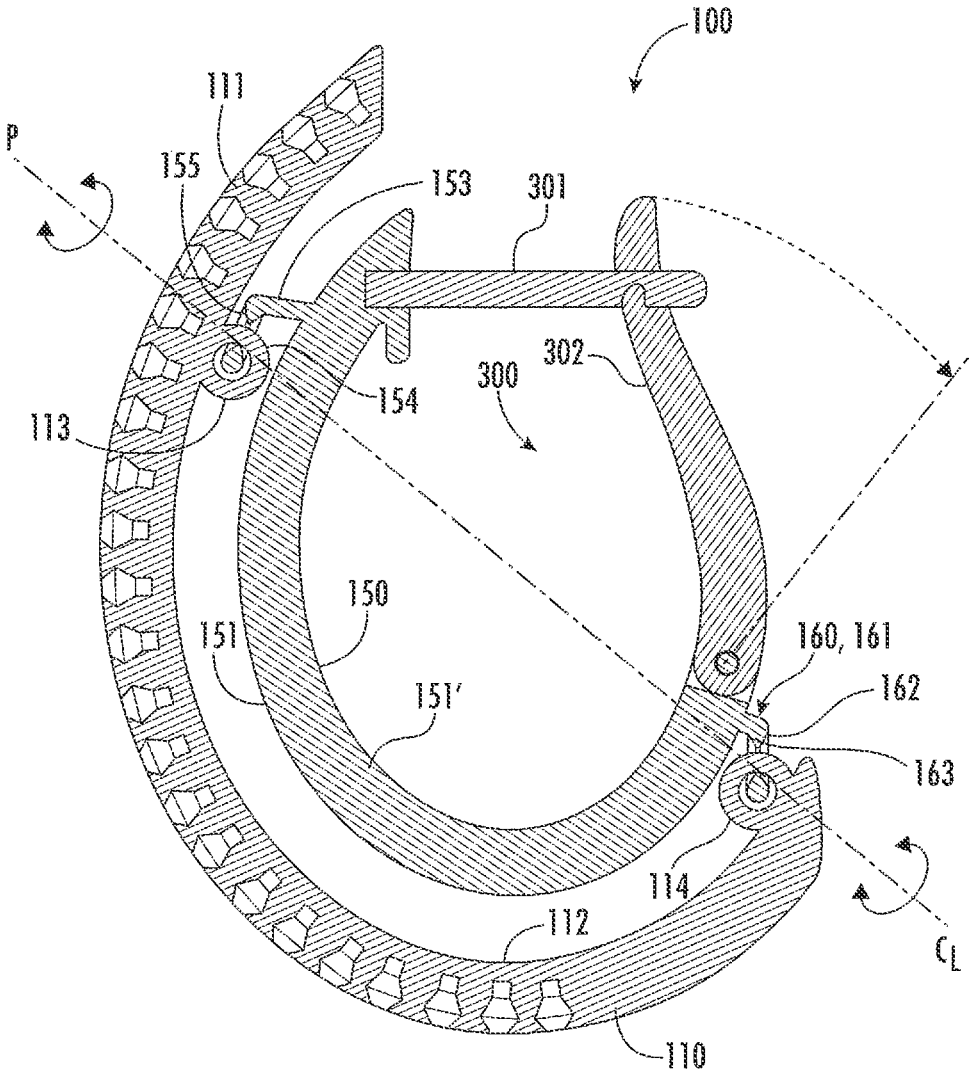
FIG. 4 is a partial section of FIG. 3 through a portion of the outer jewelry member and the inner pivot support member noting the pivot members and rings arrangement.
Figure 6:
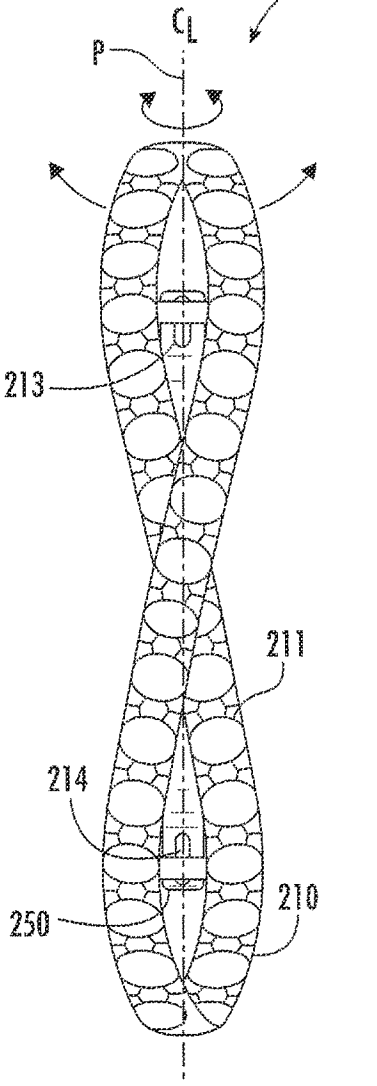
FIG. 6 is a front view of FIG. 5.
Figure 5:
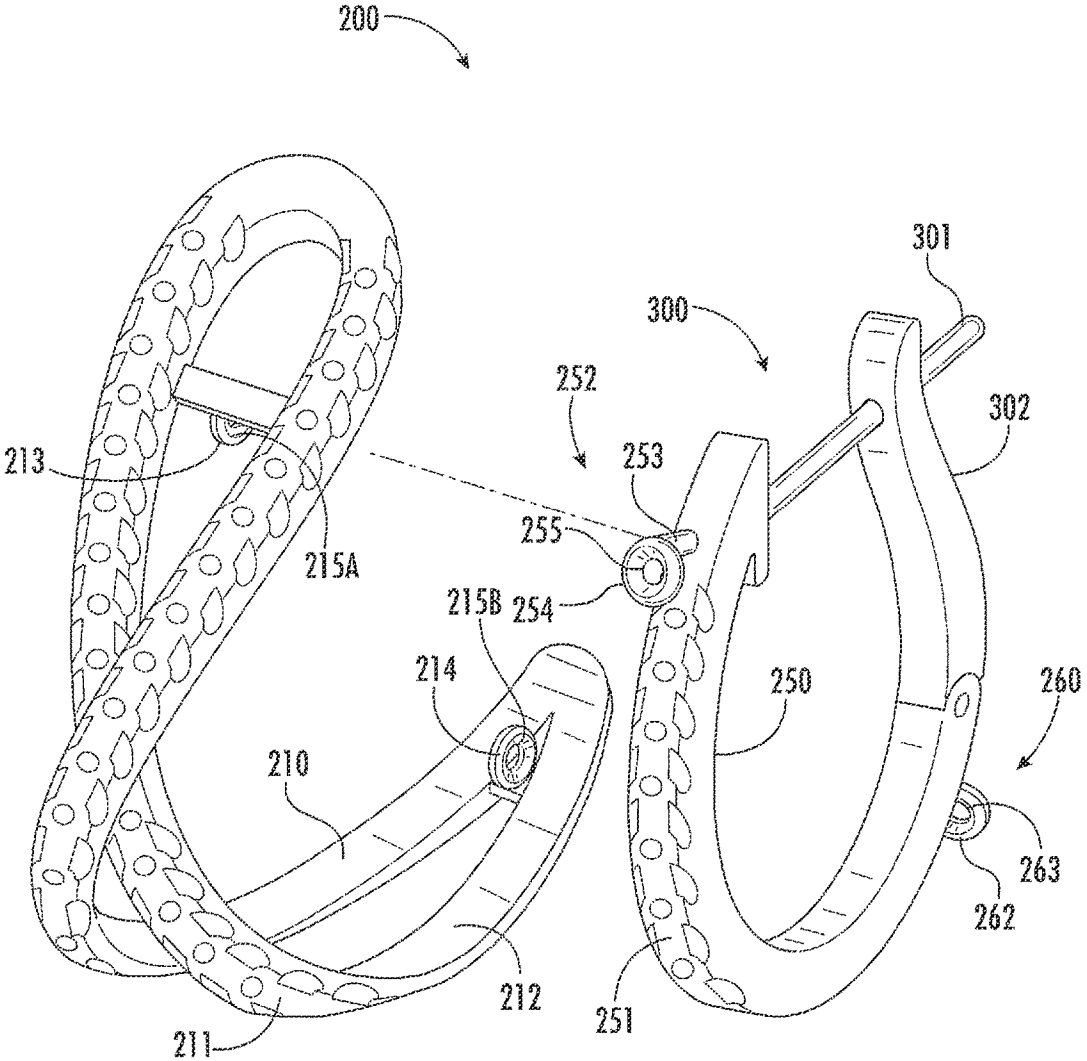
FIG. 5 is an exploded view of another alternative embodiment of a jewelry support system with differently arranged jewelry members operating on the jewelry support system as discussed herein.
Figure 7:
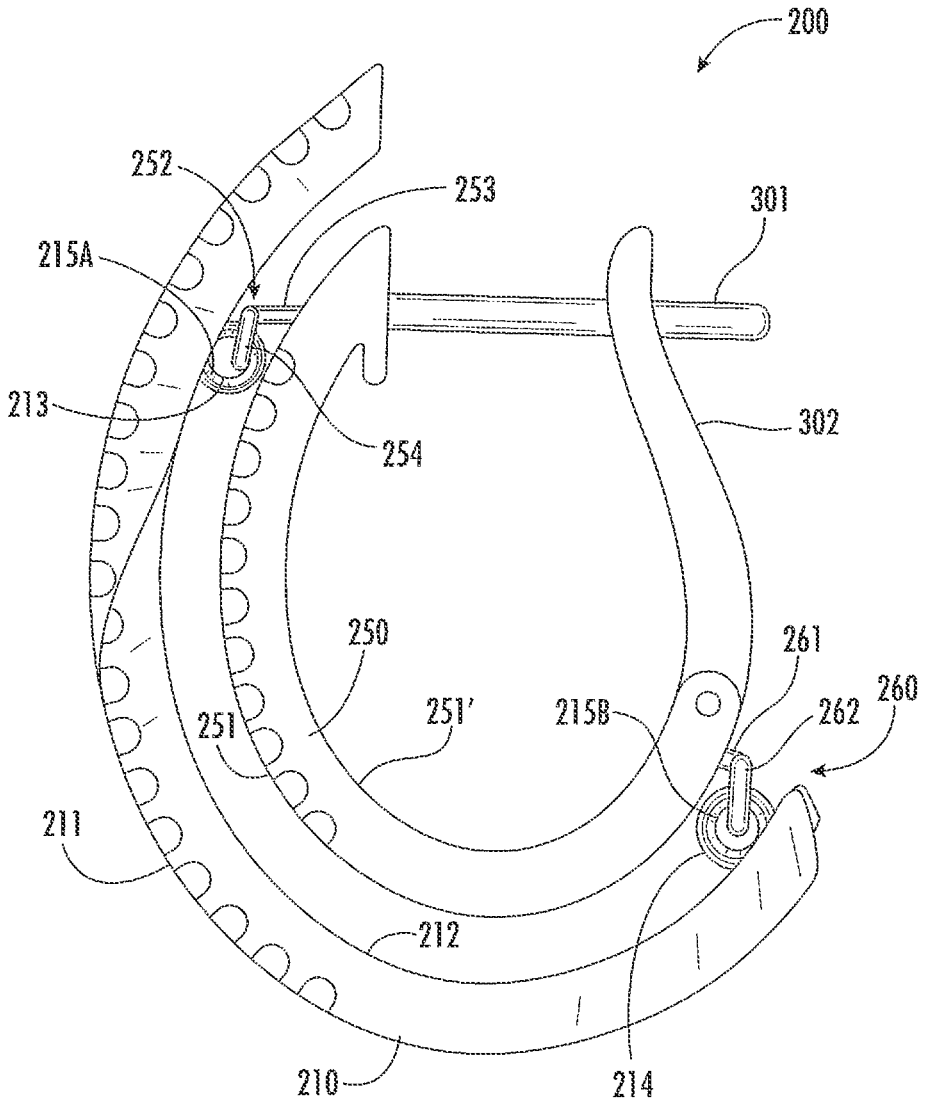
FIG. 7 is side view, of FIG. 6 (in a manner similar to FIG. 3 being a side view of FIG. 2).

Referring now to FIGS. 1-7 in combination along the following arrangement. There is a first jewelry support system 100 (FIGS. 1-4) and a second jewelry support subsystem 100 (FIGS. 5-7). An outer jewelry member 110, 210 has an outer indicia surface 111, 211 which may have any decorative indicia suitable and which is positioned opposite an inner support member 112, 212 supporting an outer top pivot ring 112, 213 and an outer bottom pivot ring 112, 214.

It will be recognized that the outer top pivot rings 112, 213 and the outer bottom pivot rings 112, 214 are aligned along a common outer pivot plane P' (see FIG. 2). In this optional embodiment shown, outer top pivot rings 112, 213 and outer bottom pivot rings 112, 214 optionally include respective outer top pivot ring tapered contact surfaces 115A, 115B and outer bottom pivot ring tapered contact surfaces 215A, 215B. It will be recognized that the tapered contact surfaces aid in free-pivoting with reduced pivot resistance and wear over time, and that the tapered contact surfaces further aid in enhancing or broadening the pivoting arc due to the narrowing of the respective pivot contact surface.

An inner pivot support member 150, 250 includes a clasp assembly 300 having a pin 301 and a pivot spring arm 302 engaging pin 301 upon a closing motion so as to secure respective jewelry support systems 100, 200 to an intended user or for storage.

Inner pivot support members have an inner indicia surface 151, 251 opposite an inner surface 151', 251', as shown.

A top inner pivot member 152, 252 is provided proximate the pin 301 and has a top extending pin 153, 253, supporting a top pivot ring 154, 254 having a top tapered contact surface 155, 255 (see FIGS. 4, 7). A bottom inner pivot member 160, 260 is presented and includes a bottom extending pin 161, 261, joining a bottom pivot ring 162, 262 having a bottom tapered contact surface 163, 263. It will be recognized (see FIG. 2) that the inner pivot support members 150, 250 and inner top pivot ring 152, 254 and inner bottom pivot ring 162, 262 are arranged having an arcuate inner surface with an uppermost apex arc aligned along an inner member pivot plane P" (see FIG. 2).

Upon assembly of the outer jewelry members 110, 210 having outer member pivot plane P' with the inner pivot support members 150, 250 having inner pivot member plane P" these planes overlay along a pivot axis (show also as pivot axis P (see FIGS. 1-6) so that outer jewelry members 110, 210 are suspended on respective upper and lower point-pivot contacts (established where the opposed rings intersect) for enhanced pivoting. It will be further realized by those of skill in this art, that the respective top and bottom tapered contact surfaces 155, 255, 163, 263 for a narrowed contact pivot radii and therefore an expanded or enhanced overall pivot radii for the outer jewelry members 110, 210 relative to respective inner pivot support members 150, 250.

It will be additionally noted that a respective vertical reference (V in FIG. 3) is provided relative to the pivot axis P/plane P so as to illustrate the respective 45-degree preferred arrangement of respective top and bottom pivot contacts (see FIG. 3). It will be further recognized that the preferred 45-degree arrangement may be varied within the parameters of the present invention due to weight/mass shift differences, so that for example a range of between 35-55 degrees may be suitable based upon a specific shape design or indicial arrangement and be suitable within the scope and spirit of the present invention.

It will be further understood that the present invention is not limited as to the materials provided which may be of any suitable kind effective to operate as disclosed herein; for example, metal, alloys, ceramics, glasses, and combinations of any suitable materials known to those of skill in the jewelry arts.

Regarding the shape or arrangement of the outer jewelry member or inner pivot support member, and whether one or both have single or multiple members (e.g., FIGS. 1 and 5) or both are single members (not shown) or both are double members (not shown); those of skill in the jewelry arts having studied the disclosure herein will recognize that the present invention encompasses and envisions alternative arrangements and shapes not shown as within the scope and spirit of the present invention.

Regarding the degree or 'amount' of pivot; it will be recognized by those of skill in the art having studied the enclosed disclosure that the degree or amount of pivoting about the common pivot plain will be determined by the user's physical structure (jaw, neck, ear) and the outer dimensions of the outer jewelry member (a very wide member may pivot only a few degrees of freedom where as a narrower outer jewelry member may pivot substantially more than 180 degrees before contacting an obstruction (e.g., at least +/−90 degrees, depending upon the position and type of support, ornament and other factors)). The images shown note that a pivot may continue until one of the support rings reaches the extending pin or stud (for example 153) which prevents further rotation. Therefore, those of skill in this art will recognize that the present invention is not limited to the present illustrations but will be broadly understood by those in this art following study of the disclosure.

Regarding the relative 'angle' of the pivot as noted in FIG. 3, while preferably the angle is 45-degrees off a vertical/horizontal (see line V), for maximum freedom of movement and weight balance it will be recognized that other relative angles may be used so that weight/balance is maintained while freedom of movement is enhanced relative to the pivot plane P (e.g., about the plane-P/operating as a pivot axis-P. The angle may be within a range of 35-55 degrees (45-degrees preferred) without departing from the scope and spirit of the present invention.

Regarding the respective tapered contact surfaces (top/bottom, and inner/outer) including 155, 255, 163, 263, 115A, 115B, 215A, 215B; those of skill in this art having appreciated the enclosed disclosure will understand that the present invention may include variation and arrangement such that one or more (or potentially all) of the respective contact surface may be either tapered or non-tapered, and may adaptively be used in combination (for example one ring may have a tapered contact surface (e.g. inner/bottom) and the corresponding ring may be non-tapered (e.g., outer/bottom)). As a result, those of skill in this art will having appreciated the enclosed disclosure will recognize that modifications and adaptations of the present embodiments are within the scope and spirit of the present invention.

Regarding the preferred embodiment shown herein, with the 'inner' part being with the clasp and relatively stationary and the 'outer part' pivoting relative thereto: It will be recognized by those of skill in this art having studied the present disclosure that the invention may additionally included an inverted-position arrangement, such that the 'inner' part is minimized and swings, while the 'outer part' now has the clasp assembly at the top and is relatively fixed so that the 'inner' part swings relative thereto (not shown but understood in the art). This is one alternative embodiment that would be recognized by those of skill in the art having studied the enclosed disclosure.

Regarding the clasp assembly as shown herein with the pivot spring arm and pin; those of skill in this art will recognize that the present clasp assembly is merely exemplary and that the intended disclosure includes the full sum of conventional clasp assemblies of all types effective to secure a jewelry system to a user's earlobe, including but not limited to puncture type and clamp types.

Regarding optional applications of the present inventive concepts, it will be recognized by those of skill the art having studied the present disclosure that the present improvements may be applied to other jewelry products (pendants, bracelets, rings, necklaces, bangles) without departing from the scope and spirit of the present invention.

Regarding ornamental indicia, those of skill in this art having studied the enclosed summary will recognize that the indicia surfaces (whether inner or outer or otherwise) may receive an ornamentation commensurate within the scope of the art without departing from this disclosure. As a result, while the indicia surfaces are shown cut or grooves to receive stones, it will be well recognized that there is no limitation on the ornamental indicia that may be presented on the surfaces (inscribing, enameling, or otherwise within the full scope of the jewelry arts). As a result, those of skill in this art will recognize that the present invention is not limited to the disclosure regarding ornamental indicia.

Also, the inventors intend that only those claims which use the specific language/words "means for" are intended to be interpreted under 35 USC 112, sixth paragraph. Moreover, no limitations from the specification are intended to be read into any claims, unless those limitations are expressly included in the claims.

Should a specific numerical value or percentage be mentioned herein, those of skill in this art, having studied the present disclosure will recognize that such values may be readily increased or decreased by 20%, while still staying within the scope and spirit of the present invention, unless a different range is specifically mentioned.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure covers modifications and variations of this disclosure provided they come within the scope of the appended claims and their equivalents.

What is claimed is:

1. A jewelry support system, comprising:

an outer jewelry member having an outer indicia surface and an inner support surface;

an inner pivot support member having a clasp assembly and an inner indicia surface along an outer surface thereof, an outer top support pivot ring and an outer bottom support pivot ring on distal ends of said outer jewelry member;

an inner top pivot member on a top extending pin projecting from a top side of said inner pivot support member;

an inner bottom pivot member on a bottom extending pin projecting from a bottom side of said inner pivot support member;

said outer top support pivot ring and said outer bottom support pivot ring being co-planar along a common pivot plane defined therebetween;

said inner top pivot member and said inner bottom pivot member arrayed along said common pivot plan and positioned perpendicular to respective said outer top support pivot ring and said outer bottom support pivot ring; and said inner top pivot member pivotally engaged with said outer top support pivot ring and said inner bottom pivot member pivotally engaged with said outer bottom support pivot ring, wherein said inner pivot support member pivotally supports said outer jewelry member so as to allow said outer jewelry member to pivot relative to said inner pivot support member along said common pivot plane.

2. The jewelry support system, according to claim 1, wherein:

said inner top pivot member having a top tapered contact surface contacting said outer top support pivot ring; and said inner bottom pivot member having a bottom tapered contact surface contacting said outer bottom pivot support ring.

3. The jewelry support system, according to claim 2, wherein:

the outer top support ring has a tapered contact surface; and the outer bottom pivot support ring has a tapered contact surface.

4. The jewelry support system, according to claim 2, wherein:

said outer jewelry support member is one of a linear outer jewelry support member and a non-linear outer jewelry support member.

5. The jewelry support system, according to claim 2, wherein:

the inner pivot support member is one of a linear inner pivot support member and a non-linear inner pivot support member.

6. The jewelry support system, according to claim 1, wherein:

said clasp assembly includes a pivot spring arm and a pin.

7. A method for assembling a jewelry support system, comprising the steps of:

providing an outer jewelry member having an outer indicia surface and an inner support surface;

providing an inner pivot support member having a clasp assembly and an inner indicia surface along an outer surface thereof, providing an outer top support pivot ring and an outer bottom support pivot ring on distal ends of said outer jewelry member;

providing an inner top pivot member on a top extending pin projecting from a top side of said inner pivot support member;

providing an inner bottom pivot member on a bottom extending pin projecting from a bottom side of said inner pivot support member;

providing said outer top support pivot ring and said outer bottom support pivot ring being co-planar along a common pivot plane defined therebetween and said inner top pivot member and said inner bottom pivot member arrayed along said common pivot plan and positioned perpendicular to respective said outer top support pivot ring and said outer bottom support pivot ring; and assembling said inner top pivot member pivotally with said outer top support pivot ring and said inner bottom pivot member pivotally with said outer bottom support pivot ring, wherein said inner pivot support member pivotally supports said outer jewelry member so as to allow said outer jewelry member to pivot relative to said inner pivot support member along said common pivot plane.

8. The method for assembling a jewelry support system, according to claim 7, wherein:

said inner top pivot member having a top tapered contact surface contacting said outer top support pivot ring; and said inner bottom pivot member having a bottom tapered contact surface contacting said outer bottom pivot support ring.

9. The method for assembling a jewelry support system, according to claim 8, wherein:

the outer top support ring has a tapered contact surface; and the outer bottom pivot support ring has a tapered contact surface.

* * * * *